US010159275B2

(12) United States Patent
Gindrat et al.

(10) Patent No.: US 10,159,275 B2
(45) **Date of Patent: *Dec. 25, 2018**

(54) APPARATUS AND METHOD FOR COMBINING TOBACCO SHEETS

(71) Applicant: PHILIP MORRIS PRODUCTS S.A., Neuchatel (CH)

(72) Inventors: Pierre-Yves Gindrat, Saxon (CH); Alessandro Metrangolo, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/812,311

(22) Filed: Nov. 14, 2017

(65) Prior Publication Data

US 2018/0064160 A1 Mar. 8, 2018

Related U.S. Application Data

(62) Division of application No. 14/899,210, filed as application No. PCT/EP2015/060533 on May 13, 2015, now Pat. No. 9,833,016.

(30) Foreign Application Priority Data

May 14, 2014 (EP) ..... 14168262

(51) Int. Cl.
*A24B 3/14* (2006.01)
*A24C 5/39* (2006.01)
(Continued)

(52) U.S. Cl.
CPC ..... *A24C 5/399* (2013.01); *A24B 3/14* (2013.01); *B65H 19/14* (2013.01);
(Continued)

(58) Field of Classification Search
USPC ..... 242/551–556
See application file for complete search history.

(56) References Cited

U.S. PATENT DOCUMENTS 3,061,220 A 10/1962 Gagg
3,749,634 A 7/1973 Krause
(Continued)

FOREIGN PATENT DOCUMENTS

CN 102090713 6/2011
DE 8434172 U1 3/1986
GB 753965 8/1956

OTHER PUBLICATIONS

PCT Search Report and Written Opinion for PCT/EP2015/060533 dated Sep. 8, 2015 (13 pages).

*Primary Examiner* — Eric Yaary
(74) *Attorney, Agent, or Firm* — Mueting, Raasch & Gebhardt, P.A.

(57) ABSTRACT

The apparatus for combining tobacco sheets comprises a first shaft for carrying a first bobbin of tobacco sheet and a second shaft for carrying a second bobbin of tobacco sheet. The apparatus also comprises a splicing unit for combining an end portion of tobacco sheet from the first bobbin to a head portion of tobacco sheet from the second bobbin. The splicing unit comprises a cutting device for cutting the tobacco sheets such as to provide complementary cuts to the tobacco sheets from the first bobbin and from the second bobbin, a dispensing device for dispensing water to at least one of the tobacco sheets, and a combining device for applying force onto the tobacco sheets thereby producing a spliced tobacco sheet.

17 Claims, 1 Drawing Sheet

(51) Int. Cl.

| | |
|---|---|
| ***B65H 19/18*** | (2006.01) |
| ***B65H 19/14*** | (2006.01) |
| ***B65H 19/20*** | (2006.01) |
| ***B65H 21/00*** | (2006.01) |

(52) U.S. Cl.

CPC ..... *B65H 19/1852* (2013.01); *B65H 19/1868* (2013.01); *B65H 19/20* (2013.01); *B65H 21/00* (2013.01); *B65H 2301/4617* (2013.01); *B65H 2301/4621* (2013.01); *B65H 2301/4625* (2013.01); *B65H 2301/4632* (2013.01); *B65H 2301/4634* (2013.01); *B65H 2301/46176* (2013.01); *B65H 2301/46178* (2013.01); *B65H 2301/517* (2013.01); *B65H 2301/5142* (2013.01); *B65H 2301/51432* (2013.01); *B65H 2408/217* (2013.01); *B65H 2408/2172* (2013.01); *B65H 2408/2411* (2013.01); *B65H 2408/24153* (2013.01)

(56) References Cited

U.S. PATENT DOCUMENTS

| | | | |
|---|---|---|---|
| 3,878,979 | A | 4/1975 | Cristiani |
| 3,886,031 | A | 5/1975 | Taitel |
| 4,371,418 | A | 2/1983 | Krywiczanin |
| 5,018,535 | A | 5/1991 | Da Silva |
| 5,405,475 | A | 4/1995 | Kraft |
| 5,468,321 | A | 11/1995 | van Liempt |
| 5,935,371 | A | 8/1999 | Distefano |
| 2003/0125686 | A1 | 7/2003 | Beitz |
| 2005/0167053 | A1 | 8/2005 | Gajewski |
| 2006/0130961 | A1 | 6/2006 | Byrne |
| 2014/0251528 | A1 | 9/2014 | Cederholm |

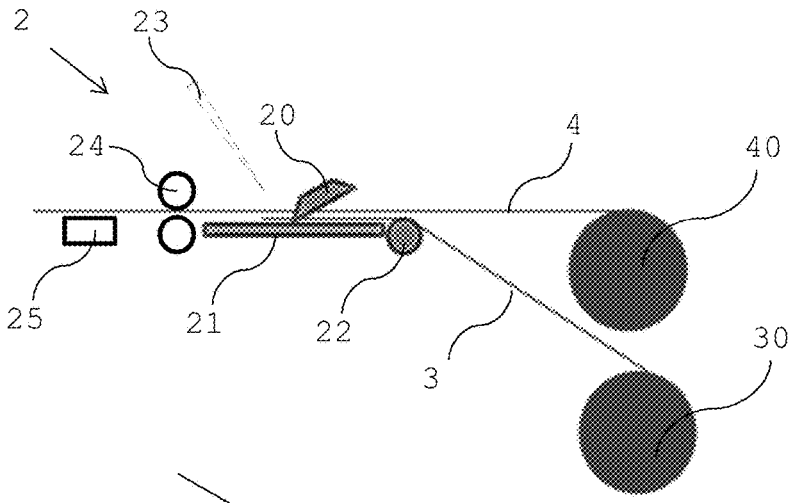
Fig. 1
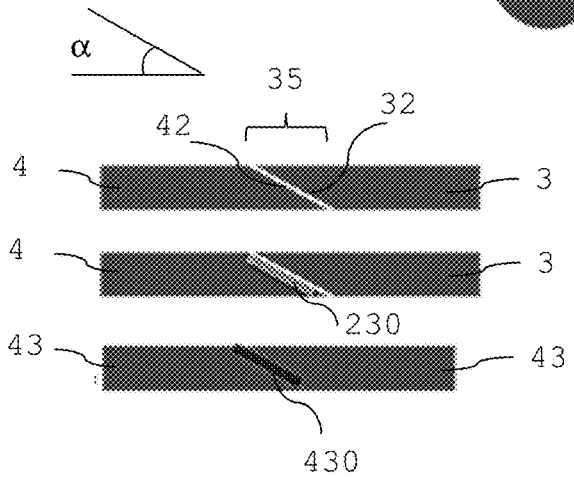
Fig. 2
Fig. 3
Fig. 4
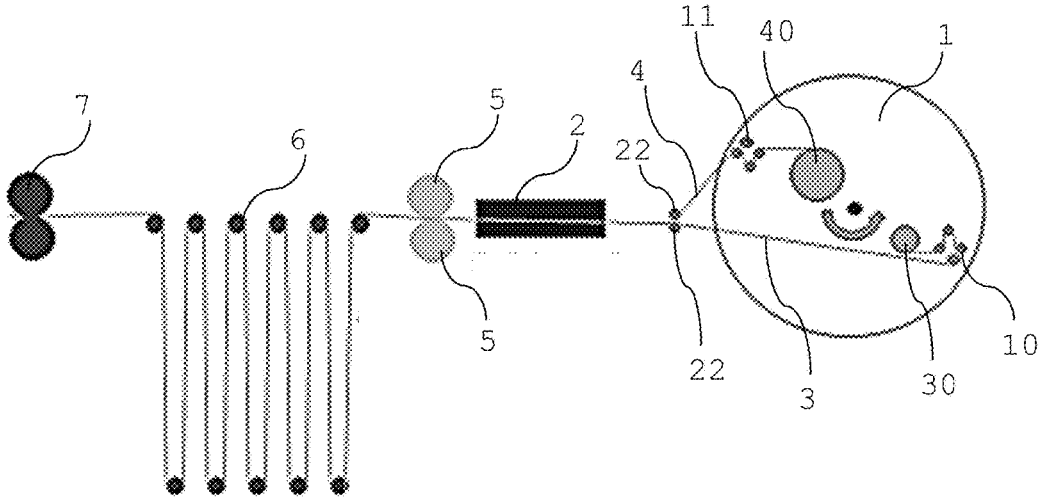
Fig. 5

APPARATUS AND METHOD FOR COMBINING TOBACCO SHEETS

This application is a divisional application of U.S. patent application Ser. No. 14/899,210, filed Dec. 17, 2015, which is a U.S. National Stage Application of International Application No. PCT/EP2015/060533, filed May 13, 2015, which was published in English on Nov. 19, 2015 as International Patent Publication WO 2015/173275 A1. International Application No. PCT/EP2015/060533 claims priority to European Application No. 14168262.5 filed May 14, 2014.

The invention relates to an apparatus and method for combining tobacco sheets, especially for use in the manufacture of smoking articles.

In smoking articles with a heat source, where tobacco is rather evaporated than combusted, a tobacco plug may be manufactured from tobacco sheet. This sheet material is heavy and the size of a bobbin is limited. Thus, at high production speed, a new bobbin has to be loaded every few minutes or even more often. This is a time consuming process, which may reduce a production speed. In addition, some processing steps in a tobacco sheet processing line do not allow for conventional joining methods for two subsequent tobacco sheets. For example, joining material such as glue may influence the taste of the final product, while taping or stapling is not effective or adds further material to the sheets; often to an extent such that for example a funneling or crimping of the joined sheet material will be hindered or rendered impossible.

Thus there is a need for an apparatus and method for a reliable joining of tobacco sheets.

According to an aspect of the present invention there is provided an apparatus for combining tobacco sheets. The apparatus comprises a first shaft for carrying a first bobbin of tobacco sheet and a second shaft for carrying a second bobbin of tobacco sheet. The apparatus further comprises a splicing unit for combining an end portion of tobacco sheet from the first bobbin to a head portion of tobacco sheet from the second bobbin. The splicing unit comprises a cutting device for cutting the tobacco sheets such as to provide complementary cuts to the tobacco sheets from the first bobbin and from the second bobbin. The splicing unit comprises a dispensing device for dispensing water to at least one of the tobacco sheets, and further comprises a combining device for applying force onto the tobacco sheets thereby producing a spliced tobacco sheet.

By providing two shafts a second bobbin with a tobacco sheet may be provided before a first bobbin with tobacco sheet comes to an end. In addition, the tobacco sheets may securely be connected to each other while tobacco sheet is continuously provided to a processing line, for example into a crimping unit or a rod forming device. This is especially favorable in processing lines with high production speed, for example tobacco rod crimping lines, where replacement of a bobbin needs to be performed at high frequency and the processing line shall not be slowed down.

Cutting the tobacco sheets provides a defined end portion of a previous tobacco sheet and defined head portion of a subsequent tobacco sheet that are to be combined to provide an ongoing continuous tobacco sheet. Thus, also the lateral extensions of a region the tobacco sheets are combined is defined and may be limited in size, which may reduce waste if overlap areas are removed.

The cutting may be performed to the tobacco sheets in a subsequent manner. Preferably, cutting is performed for both tobacco sheets simultaneously. For the cutting process, the sheets may be arranged next to each other or may overlie each other. Preferably, the tobacco sheets are aligned to lie above each other in a centered manner along a longitudinal central axis of the tobacco sheets. The cutting provides complementary cuts that provide clearly defined contact areas, where the two tobacco sheets may contact each other and may be joined to each other. This further supports a good connection between the tobacco sheets. The cutting may also be performed at an angle. By this, a cutting face on a tobacco sheet may be enlarged, thus further supporting the connection of the tobacco sheets. In addition, by slanted cuts the tobacco sheets may overlap each other without adding any or any substantial thickness to the combined sheets in the overlapping region of the tobacco sheets. Preferably, the two tobacco sheets overlap with their cutting faces only.

Adding water to at least one of the tobacco sheets moistens and softens the material of the tobacco sheet. While the material of the tobacco sheet may have a certain tackiness by itself, such tackiness may be enhanced by adding water. Preferably, water is added to a cutting face only, preferably of one tobacco sheet only. By this, the added water may support the combining process of the tobacco sheets in the contact area of the sheets without excess water that might negatively affect a connection.

The subsequently applied force to the tobacco sheets, in at least the overlap region, provides a strong connection between two tobacco sheets. The combining device may act upon the combined tobacco sheet, while the sheet is stationary or while it further moves along a moving direction. A combining device may for example comprise a stationary press or for example pressing rollers. The amount of force applied is adapted to provide a good connection, however, preferably without thinning or substantially thinning the tobacco sheets in the overlap region.

With the apparatus according to the invention, a strong connection may be provided with no additives or additional material that might influence taste. In addition, a connection may be provided that has no or reduced effect on processes subsequent to the splicing process in a tobacco sheet processing line. Such subsequent processes may for example be a subsequent crimping process or rod forming process. With the apparatus according to the invention, a processing line may be continuously operated at high speed with ongoing constant quality of the product to be manufactured. In addition, any waste material possibly produced may be kept at a minimum.

Cast leaf tobacco is a form of reconstituted tobacco that is formed from a slurry including tobacco particles, fiber particles, aerosol formers, flavors, and binders. Tobacco particles may be of the form of a tobacco dust having a particle size preferably on the order between about 30-80 microns or about 100-250 microns, depending on the desired sheet thickness and casting gap. Fiber particles may include tobacco stem materials, stalks or other tobacco plant material, and other cellulose-based fibers, such as wood fibers having a low lignin content. Fiber particles may be selected based on the desire to produce a sufficient tensile strength for the cast leaf versus a low inclusion rate, for example, a rate between approximately 2-15%. Alternatively or additionally, fibers, such as vegetable fibers, may be used either with the above fibers or in the alternative, including hemp and bamboo.

Aerosol formers may added to the slurry that forms the cast leaf tobacco. Functionally, the aerosol former should be capable of vaporizing within the temperature range at which the cast leaf tobacco is intended to be used in the tobacco product, and facilitates conveying nicotine and/or flavouring in an aerosol when the aerosol former is heated above its vaporization temperature. The aerosol former is preferably chosen based on its ability to remain chemically stable and essentially stationary in the cast leaf tobacco at or around room temperature, but which is able to vaporize at a higher temperature, e.g., between 40-450° C.

As used herein, the term aerosol refers to a colloid comprising solid or liquid particles and a gaseous phase. An aerosol may be a solid aerosol consisting of solid particles and a gaseous phase or a liquid aerosol consisting of liquid particles and a gaseous phase. An aerosol may comprise both solid and liquid particles in a gaseous phase. As used herein both gas and vapour are considered to be gaseous.

Preferably, the aerosol former is polar and is capable of functioning as a humectant-, which can help maintain moisture within a desirable range in the cast leaf tobacco.

Aerosol formers may be selected from the polyols, glycol ethers, polyol ester, esters, and fatty acids and may comprise one or more of the following compounds: glycerin, erythritol, 1,3-butylene glycol, tetraethylene glycol, triethylene glycol, Triethyl citrate, propylene carbonate, ethyl laurate, triacetin, meso-erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

One or more aerosol former may be combined to take advantage of one or more properties of the combined aerosol formers. For example, triacetin may be combined with glycerin and water to take advantage of the triacetin's ability to convey active components and the humectant properties of the glycerin.

According to an aspect of the apparatus according to the invention, the cutting device comprises a cutting edge, which is arranged at a cutting angle relative to a support surface of the splicing unit. This enables to cut the tobacco sheets at an angle relative to the plane spanned by the tobacco sheet. The tobacco sheets may be overlapping with their cutting faces. If the cutting faces exactly overlap each other, a thickness of the overlapping tobacco sheets is not larger than the thickness of a single tobacco sheet. If the tobacco sheets overlap with each other's cutting faces only partially, the thickness of the spliced tobacco sheet is still smaller than the thickness of two tobacco sheets laid onto each other. By not limiting the overlapping to exactly the cutting faces, an overlapping area may be enhanced without doubling the thickness of the spliced tobacco sheet.

In addition, by including a cutting angle under which the tobacco sheets are cut, a cutting face on a tobacco sheet may be enlarged compared to a straight cut perpendicular to the plane spanned by the tobacco sheet. Aligning the two cut tobacco sheets such that the two cutting faces rest against each other enlarges a contact area between the two tobacco sheets and thus supports a splicing process. This is especially favorable, if the overlapping but not yet firmly spliced tobacco sheets are moved, for example into the combining device.

Preferably, the tobacco sheet is arranged horizontally and is guided along the support surface of the splicing unit.

In some preferred embodiments of the apparatus according to the invention, the cutting angle is in a range between about 20 degrees and about 50 degrees, preferably in a range between about 25 degrees and about 40 degrees, for example 30 degrees. Such cutting angles are convenient to be cut, for example by a cutting knife. They also provide large cutting faces, which allow for a large overlapping area by still allowing to keep the thickness of the spliced tobacco sheet preferably substantially corresponding to the thickness of a single tobacco sheet.

According to another aspect of the apparatus according to the invention, the combining device is capable of applying a pressure of greater than about 200 Newton, preferably greater than about 250 Newton onto the tobacco sheets. Forces in these ranges applied to two overlapping tobacco sheets have provided stable connections between tobacco sheets without damaging the sheets or without or without substantially thinning the tobacco sheets in the overlap region. It becomes apparent to a person skilled in the art that a minimum force applied may also be dependent on a speed of the tobacco sheet to be spliced and may thus be adapted to a velocity of the splicing process. The combining device may for example be realized as one or two rollers the combined tobacco sheets are passed through. By rollers, a combining may be performed while the combined tobacco sheet is further moved into a processing direction. In addition, with rollers shearing forces during a combining process may be minimized or eliminated.

According to yet another aspect of the apparatus according to the invention, the apparatus further comprises a bobbin holder comprising the first and the second shaft, wherein the first and the second shaft on the bobbin holder are moveable such that the positions of the first and the second shaft are interchangeable with each other. The shafts may be arranged in a movable manner on the bobbin holder or they may be fixedly arranged on the bobbin holder. In the latter case, the bobbin holder is movable, for example rotatable, such that the second bobbin may be positioned at the former position of the first bobbin and vice versa. By this, tobacco sheet may be supplied through the splicing unit after splicing at a same angle. In addition, the first bobbin may be replaced while tobacco sheet supply is still ongoing. Yet further, tobacco sheet from a fresh bobbin replacing the first bobbin may be brought into position for splicing, while supply is still ongoing. The bobbin holder may also support a repeatability of the bobbin replacement process, by enabling the provision of the new tobacco sheet (to be spliced to the tobacco sheet in use) in an identical manner. For example, a direction of supply of the new tobacco sheet may be kept the same and also the velocity of the splicing process may be kept identical. In addition, if a loading position of a new bobbin is always identical, a loading of new bobbins may be automatized or supported, for example by grippers and lifts, removing a used-up bobbin and lifting a fresh bobbin to be loaded to the bobbin holder.

While the apparatus has been described by the provision of two shafts for two bobbins, the bobbin holder may also be provided with one or several further shafts for one or several further bobbins of tobacco sheet. While other interchanging mechanisms for the shafts are feasible, the positions of the plurality of shafts are preferably be brought into each other's position upon rotation of the bobbin holder or by rotating the shafts on the bobbin holder, respectively.

The apparatus according to the invention may also comprise a sensor for detecting an upcoming end of bobbin. A respective signal may be sent to a control unit, which then initiates the splicing process.

According to a further aspect of the apparatus according to the invention, the apparatus comprises a drying unit for drying the spliced tobacco sheet. Preferably, the drying is provided in at least the overlapping region or in the region where water has been applied to the tobacco sheets. Drying may support a splicing process by speeding up the process of removing any water that had been dispensed to the tobacco sheet before joining the sheets. Preferably, a drying unit comprises a heater, for example based on hot air or on infrared heating.

According to a further aspect of the apparatus according to the invention, the apparatus further comprises a buffer unit arranged downstream of the splicing unit, the buffer unit for storing an amount of spliced tobacco sheet. A buffer unit may compensate for a change in transportation speed of the tobacco sheet. Such a change in transportation speed may be caused in the processing line on the side of the initial supply of tobacco sheet, in the splicing unit or further downstream, for example in a crimping or rod forming process. Tobacco sheet stored in the buffer unit for example makes up for a change of speed if supply of tobacco sheet has to be stopped or reduced in speed for performing the splicing process.

Overlap regions in the tobacco sheet may not fulfil specifications of the tobacco sheet material to be used in a product, such as for example a tobacco plug in a smoking article. Thus, a rod portion comprising an overlap region (i.e. a connection of the two joined sheets) may be rejected and removed from further product manufacturing. This may for example be done by providing a rejector further downstream in the tobacco sheet processing line, such as for example at a location after a rod has been formed and is being cut into individual tobacco segments. Identification of overlap regions may be done by appropriate control or sensing means, for example optical detection systems. It is for example possible to detect and store a position of an overlap region in the tobacco sheet in a control unit. This may, for example, be the position where the connection is formed, for example in the splicing unit. A tobacco sheet portion containing the overlap region that has travelled by a distance from the splicing unit to the rod cutting position is then removed.

According to a further aspect of the present invention, there is provided a method for combining tobacco sheets. The method comprises the steps of providing a first tobacco sheet and providing a second tobacco sheet and aligning and cutting the first and the second tobacco sheets such as to provide the first and the second tobacco sheets with complementary cuts. The method further comprises the steps of dispensing water to at least the first or the second tobacco sheet and aligning the complementary cuts of the first and of the second tobacco sheet such that the complementary cuts rest against each other. Yet further, the method comprises the step of applying pressure onto the first and the second tobacco sheets in a cut area thereby combining the first and the second tobacco sheets and forming a spliced tobacco sheet.

According to an aspect of the method according to the invention, the step of cutting the first and the second tobacco sheet comprises cutting the tobacco sheets at a cutting angle in a range between about 20 degrees and about 50 degrees, preferably in a range between about 25 degrees and about 40 degrees, for example at a cutting angle of 30 degrees.

Several aspects and advantages of the method have been described relating to the apparatus according to the invention. Thus, these will not be repeated.

According to a further aspect of the method according to the invention, the method further comprises the step of overlapping the first and the second tobacco sheet for more than 4 Millimeters, preferably more than 6 Millimeters, for example 8 Millimeters before performing the step of applying pressure. Preferably, this overlap is limited to the cut area that is to the complete or partial overlap of the complementary cuts. By this, the thickness of the two tobacco sheets becomes not or not substantially more than the thickness of one tobacco sheet and is less than the thickness of both tobacco sheets overlying each other in a section outside of the cut area.

According to another aspect of the method according to the invention, the step of dispensing water comprises applying water to a lower lying tobacco sheet only, preferably to a cutting face of the lower lying tobacco sheet only. The amount of water applied may be kept at a minimum and may be limited to the location, where it is needed for forming the connection. Water may also be applied making use of gravitational force. In addition, water applied to a lower lying tobacco sheet, water does not tend to run or drip off the sheet.

Preferably the tobacco sheets are processed and spliced by supplying the tobacco sheets while lying above each other. Cutting, watering and combining may thus be performed without having to rearrange any of the two tobacco sheets. In some of these embodiments, after cutting, a cut waste end portion of the first tobacco sheet is removed and a cut waste head portion of the second tobacco sheet is removed before performing the step of applying pressure. Upon cutting the two overlying tobacco sheets, a waste end portion of the 'to-be-replaced' tobacco sheet and a waste head portion of the 'fresh' tobacco sheet are cut away. Removing these waste cut-away portions facilitates the application of force to the two cut areas of the end and head portion of the two tobacco sheets to be joined. In addition, by removing the waste portions, the head and end portion may automatically be arranged next to each other, not requiring any further aligning.

According to yet another aspect of the method according to the invention, the method further comprises the steps of changing a position of a second bobbin with the second tobacco sheet to a position of a first bobbin with the first tobacco sheet and vice versa after combining the first and the second tobacco sheet, replacing the first bobbin by a further bobbin, and providing a tobacco sheet from the further bobbin for combining with the second tobacco sheet. Preferably, the changing of positions is performed in a same direction, preferably by rotation of the bobbins.

According to a further aspect of the method according to the invention, the method further comprises the step of introducing the combined tobacco sheet into a crimping device for crimping the spliced tobacco sheet.

Preferably, the apparatus and method according to the invention are used in the manufacture of smoking articles, such as smoking articles comprising a heat source and a tobacco plug, wherein the tobacco is rather evaporated than combusted.

It becomes apparent to a person skilled in the art that a minimum overlap and a force applied may also be dependent on a speed of the combined tobacco sheet is to be proceeded and thus on a velocity of the splicing process.

The invention is further described with regard to embodiments, which are illustrated by means of the following drawings, wherein FIG. 1 shows an embodiment of the splicing process;

FIGS. 2-4 show steps of the splicing process with the aligned tobacco sheets (FIG. 2); applied water (FIG. 3) and spliced tobacco sheets (FIG. 4);

FIG. 5 shows an embodiment of the apparatus including bobbin holder and buffer unit.

In FIG. 1 a first and a second tobacco sheet 3, 4 are supplied from respective bobbins 30, 40 to a splicing unit 2. The first tobacco sheet 4 is in use and is passing in a substantially straight direction through the splicing unit 2. It is further transported to tobacco sheet processing units arranged further downstream (not shown). Such processing units may for example be a crimping unit or a rod forming unit. Before tobacco sheet 4 on bobbin 40 comes to an end, tobacco sheet 3 from the second bobbin 30 is guided via guide pulley 22 and supplied to the splicing unit 2 (here from below tobacco sheet 4 in use). Both tobacco sheets 3, 4 are arranged on top of each other and aligned on a support surface 21 of the splicing unit. They are then cut under a cutting angle α by cutting knife 20. By the cut, a clearly defined end portion of the first tobacco sheet 3 and a clearly defined head portion of the second tobacco sheet 4 is provided. A waste end portion and waste head portions may be removed after cutting the tobacco sheets 3, 4. While the cutting does not necessarily have to be performed with aligned tobacco sheets, the splicing process does. As can be seen in FIGS. 2 to 4, the tobacco sheets 3, 4 that have been cut are then aligned above each other with their cutting faces 42, 32 to overlie each other. While the cutting direction in FIGS. 2 to 4 is inversed with respect to the cutting direction of the cutting knife 20 of FIG. 1, the splicing process is the same. The cutting angle α is in both figures about 30 degrees.

With a dispensing unit 23 water is dispensed onto the lower lying tobacco sheet 4 (tobacco sheet 3 in FIG. 1 due to the different cutting direction) and onto the cutting face 42 only, as shown in FIG. 3. By a thin water layer 230 applied to one tobacco sheet only, the water may soften the material of the tobacco sheets 3, 4 at least in the area of the cutting faces 32,42 to support a good interconnection of the sheets 3, 4 in the overlapping area 35. However, the amount of water is small enough to not disintegrate the tobaccos sheets, which might complicate or hinder the formation of a joint.

The so overlying and wetted tobacco sheets 3, 4 are then guided through compressing rollers 24. The sheets are compressed upon passing between the compressing rollers, which securely fixes the two cutting faces 42, 32 and the two tobacco sheets 3, 4 to each other. A short but firm connection 430 is formed as indicated in FIG. 4. To support the joint formation, a heating unit 25, for example a hot air source or a heat radiating source, is arranged downstream adjacent the compressing rollers 24. By the heat, the connection is quickly dried such that the now spliced tobacco sheet 43 may continue to be provided to further downstream arranged processing units. Since no additives for the splicing are used and since depending on the size of the overlap area 35, no significant thickening or thinning of the spliced sheet exists, a spliced tobacco sheet may entirely be used, including the connection 430. However, the overlap area 35 with the connection 430 may at a later stage also be removed to secure identical product specifications.

By the splicing process according to the invention, the splicing of tobacco sheets 3, 4 may be performed in a fast and secure manner such that a tobacco sheet treatment line may continuously be operated, preferably at a constant high velocity of for example up to 200 meter per second. To further support a continuous high operation speed, a splicing process may further be automated by the provision of an automatic bobbin changer.

In FIG. 5 a rotatable bobbin holder 1 is arranged upstream of the splicing unit for splicing the two tobacco sheets 3, 4. The bobbin holder 1 is provided with two bobbins 30, 40 carrying the two tobacco sheets 3, 4. Tobacco sheet 3 is continuously provided to and through the splicing unit 2 from bobbin 30.

The first bobbin 30 is almost used up and has been rotated in anti-clockwise direction (indicated by arrow) by the bobbin holder away from the splicing unit 2. Upon the same rotating movement, the second bobbin 40 has been moved closer to the splicing unit 4. The tobacco sheet 4 from the second bobbin 40 is guided via guide pulley 22 into the splicing unit, where splicing may be performed. After cutting in the splicing unit, the then cut off first tobacco sheet 3 may be removed together with the bobbin 30 from the bobbin holder 1. It may be replaced by a new bobbin. As soon as the bobbin 40 comes to an end, the process may be started again.

By this process a new bobbin is provided and prepared for the tobacco sheet on the new bobbin to being spliced with the tobacco sheet in use, while tobacco sheet is continuously provided to the tobacco processing line.

Downstream of the splicing unit 2, an acceleration unit in the form of two acceleration rollers 5 is arranged. The tobacco sheet being passed through the splicing unit 2 may be accelerated or slowed down by the acceleration unit 5. The tobacco sheet may be continuously accelerated upon passing between the two acceleration rollers 5 in order to secure a continuous velocity of the tobacco sheet. Preferably, for the splicing process, the tobacco sheet may be decelerated or stopped by the acceleration rollers 5. After a splicing process, the spliced tobacco sheet may be accelerated again to a process velocity. A buffer unit 6 is arranged further downstream of the acceleration unit 5. The buffer unit 6 is a series of idler pulleys, where the tobacco sheet is guided around and forms loops of tobacco sheet. Some of the idler pulleys are arranged in a movable manner such as to enlarge or smaller a tobacco sheet loop in order to be able to further provide tobacco sheet material in a downstream direction, even when a supply from the splicing unit 2 or from a bobbin 30, 40 is interrupted or reduced.

Downstream of the buffer unit 6 a pulling unit 7 pulls tobacco sheet out of the buffer unit to pass tobacco sheet preferably at a constant velocity to further downstream arranged tobacco sheet processing units.

The bobbin holder is preferably rotated such that a new tobacco sheet may be provided from above. This simplifies the positioning of the new tobacco sheet on the upper surface of the tobacco sheet in use to be joined therewith.

An arrangement of mechanical dancer and pulley rolls 10, 11 is provided on the bobbin holder 1. They are arranged next to each of the respective bobbins 30, 40. The tobacco sheets 30, 40 are guided over the rolls 10, 11 before being supplied into the splicing unit. By providing mechanical dancers and pulleys 10, 11 a controlled guiding of the tobacco sheet, as well as a constant tightening of the tobacco sheet may be achieved. This is especially favorable for tobacco sheet that tends to split or break upon large or irregular tearing or pulling forces. Especially, the rolls make up for varying pulling forces upon rotating the bobbins on the bobbin holder.

The apparatus and process automatizes the feeding of tobacco sheet into a tobacco sheet treatment line. It not only allows to provide a new bobbin while tobacco sheet is continuously provided to the tobacco processing line. It also allows to splice two tobacco sheets while tobacco sheet may continuously be provided to the tobacco processing line. By this, production speed of for example a tobacco rod crimping line may be kept at a constant high level.

The invention claimed is:

1. Method for combining tobacco sheets, the method comprising the steps of:

providing a first tobacco sheet and providing a second tobacco sheet;

aligning and cutting the first and the second tobacco sheets such as to provide the first and the second tobacco sheets with complementary cuts;

dispensing water to at least the first or the second tobacco sheet;

aligning the complementary cuts of the first and of the second tobacco sheet such that the complementary cuts rest against each other; and applying pressure onto the first and the second tobacco sheets in a cut area thereby combining the first and the second tobacco sheets and form a spliced tobacco sheet.

2. Method according to claim 1, wherein the step of cutting the first and the second tobacco sheet comprises cutting the tobacco sheets at a cutting angle in a range between about 20 degrees and about 50 degrees.

3. Method according to claim 1, wherein the step of cutting the first and the second tobacco sheet comprises cutting the tobacco sheets at a cutting angle in a range between about 25 degrees and about 40 degrees.

4. Method according to claim 1, wherein the step of cutting the first and the second tobacco sheet comprises cutting the tobacco sheets at a cutting angle of 30 degrees.

5. Method according to claim 1, further comprising the step of overlapping the first and the second tobacco sheet by more than 4 millimeters before performing the step of applying pressure.

6. Method according to claim 1, further comprising the step of overlapping the first and the second tobacco sheet by more than 6 millimeters before performing the step of applying pressure.

7. Method according to claim 1, further comprising the step of overlapping the first and the second tobacco sheet 8 millimeters before performing the step of applying pressure.

8. Method according to claim 1, wherein the step of dispensing water comprises applying water to a lower lying tobacco sheet only.

9. Method according to claim 1, wherein the step of dispensing water comprises applying water to a cutting face of a lower lying tobacco sheet only.

10. Method according to claim 1, further comprising the step of removing a cut waste end portion of the first tobacco sheet and removing a cut waste head portion of the second tobacco sheet before performing the step of applying pressure.

11. Method according to claim 1, further comprising the steps of:

changing a position of a second bobbin with the second tobacco sheet to a position of a first bobbin with the first tobacco sheet and vice versa after combining the first and the second tobacco sheet;

replacing the first bobbin by a further bobbin; and providing a tobacco sheet from the further bobbin for combining with the second tobacco sheet.

12. Method according claim 1, further comprising the step of introducing the combined tobacco sheet into a crimping device for crimping the spliced tobacco sheet.

13. Method according to claim 2, further comprising the step of overlapping the first and the second tobacco sheet by more than 4 millimeters before performing the step of applying pressure.

14. Method according to claim 5, wherein the step of dispensing water comprises applying water to a lower lying tobacco sheet only.

15. Method according to claim 2, further comprising the step of removing a cut waste end portion of the first tobacco sheet and removing a cut waste head portion of the second tobacco sheet before performing the step of applying pressure.

16. Method according to claim 5, further comprising the step of removing a cut waste end portion of the first tobacco sheet and removing a cut waste head portion of the second tobacco sheet before performing the step of applying pressure.

17. Method according to claim 1 to manufacture smoking articles.

* * * * *